United States Patent [19]

Kobayashi et al.

[11] Patent Number: 4,568,852

[45] Date of Patent: Feb. 4, 1986

[54] CATHODE RAY TUBE WITH LIQUID COOLANT AND REDUCED X-RAY EMISSION

[75] Inventors: Katsumi Kobayashi, Machida; Tomosuke Chiba, Matsudo; Masahiro Kikuchi, Tokyo, all of Japan

[73] Assignee: Sony Corporation, Tokyo, Japan

[21] Appl. No.: 472,749

[22] Filed: Mar. 7, 1983

[30] Foreign Application Priority Data

Mar. 9, 1982 [JP] Japan ..... 57-36965

[51] Int. Cl.[4] ..... H01J 29/89

[52] U.S. Cl. ..... 313/36; 313/44; 313/474; 313/478

[58] Field of Search ..... 313/35, 36, 44, 45, 313/461, 474, 477 R, 478, 112; 358/247, 237, 253

[56] References Cited

U.S. PATENT DOCUMENTS

| | | | |
|---|---|---|---|
| 2,342,778 | 2/1944 | Wolff | 313/477 R X |
| 3,422,298 | 1/1969 | Gier | 313/478 |
| 3,524,197 | 8/1970 | Soule | 313/44 X |
| 3,531,674 | 9/1970 | Spencer | 313/44 |
| 4,393,329 | 7/1983 | Lehnert | 313/461 X |

FOREIGN PATENT DOCUMENTS

| | | | |
|---|---|---|---|
| 2098393A | 11/1982 | United Kingdom | 313/478 |

*Primary Examiner*—David K. Moore
*Assistant Examiner*—K. Wieder
*Attorney, Agent, or Firm*—Hill, Van Santen, Steadman & Simpson

[57] ABSTRACT

A cathode ray tube apparatus having a glass panel in front of the phosphor screen made of a material which has an X-ray absorption coefficient larger than that of the backing on which the phosphor layer is applied. The two panels are separated by means of a spacer and a liquid coolant is incorporated into the space between the panels to enhance the heat radiation effect of the phosphor surface and to avoid the radiation of X-rays.

3 Claims, 6 Drawing Figures

CATHODE RAY TUBE WITH LIQUID COOLANT AND REDUCED X-RAY EMISSION

BACKGROUND OF THE INVENTION

1. Field of the Invention

The present invention is directed to a cathode ray tube apparatus of the liquid cooling type which is particularly suitable for use with video projectors and the like.

2. Description of the Prior Art

Typical color video projectors include three cathode ray tubes which supply the red, green and blue color signals to produce the corresponding colors on the projection screen. The picture images from the cathode ray tubes are magnified and then projected onto a screen by a lens system. Cathode ray tubes used for this type of application must have a higher brightness as compared with conventional cathode ray tubes. Consequently, the tubes are driven by relatively high voltage with high current densities. This increased drive causes an increased emission of X-rays and also leads to deterioration of the phosphor surfaces because of the rise in temperature on the phosphor screens.

There have been some attempts to avoid the X-rays radiated from the cathode ray tubes by employing a glass having a large X-ray absorption coefficient. However, such glass is likely to cause a browning phenomemon caused by the impingement of the electron beam, resulting in a decrease of brightness. Consequently, it has become practice to use a glass whose X-ray absorption coefficient is relatively small to avoid such browning, and increase the thickness. However, if the thickness of the phosphor panel is increased the heat radiation effects from the panel are lowered and a deterioration of brightness caused by a rise in temperature of the phosphor screen is made more of a problem.

In order to improve the deterioration of brightness caused by the rise of temperature on the phospor screen, a cathode ray tube apparatus of liquid-cooling type has been proposed in an application filed on behalf of the same assignee as the present application, and appearing in U.S. Ser. No. 156,204.

SUMMARY OF THE INVENTION

The present invention provides an improved cathode ray tube apparatus particularly useful in a multi-tube arrangement for video projectors. In accordance with the present invention, a glass panel is held by means of a spacer in spaced relation to the phosphor panel, the space between the two being filled with a liquid coolant. The X-ray absorption coefficient of the front panel is significantly larger than that of the panel on which the phosphor layer appears. The result is a better dissipation of the heat, and a more efficient absorption of emitted X-rays.

DESCRIPTION OF THE PREFERRED EMBODIMENTS

Figure 1:
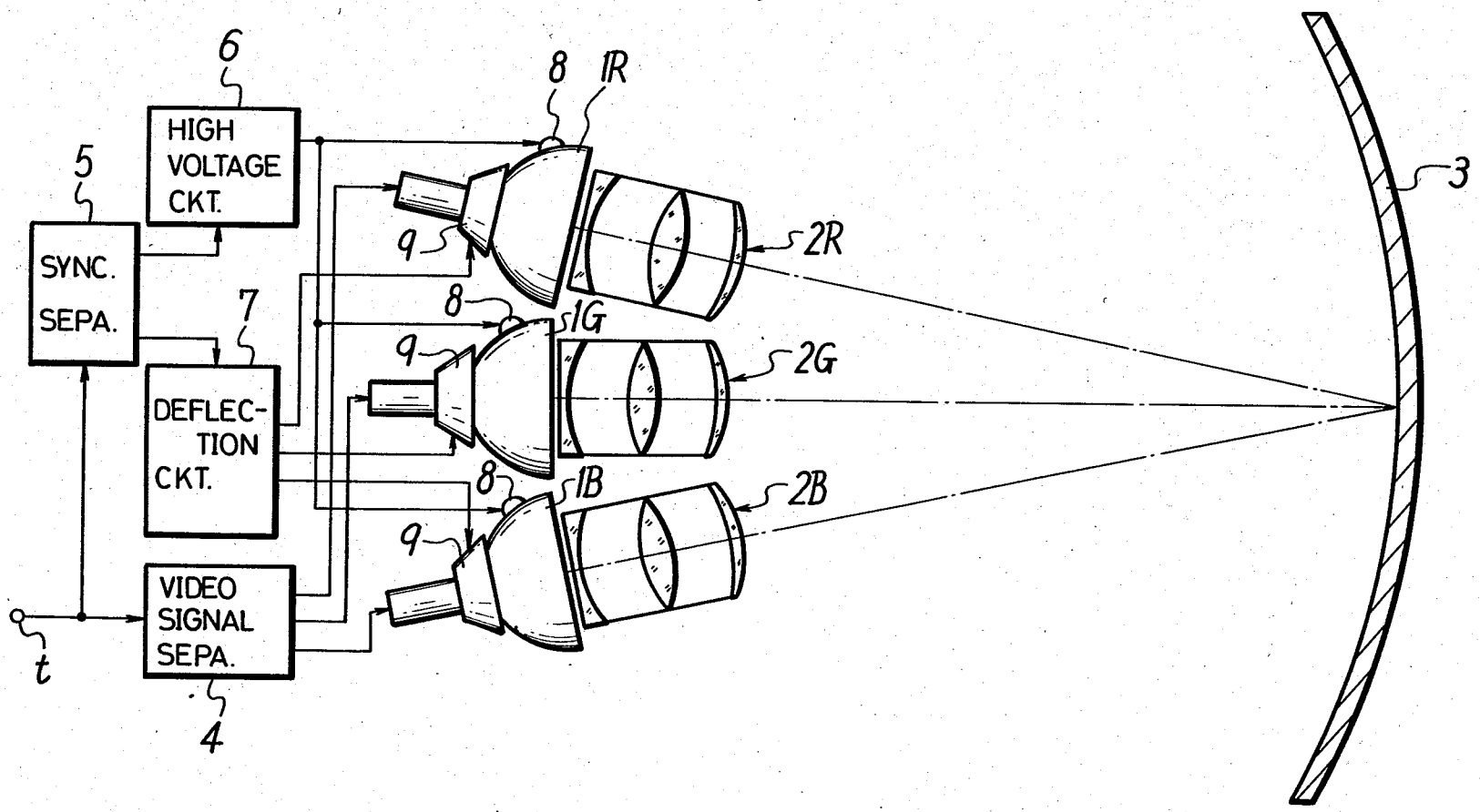
FIG. 1 is a relatively schematic view of a video projector system illustrating the manner in which the improvements of the present invention can best be used.

In FIG. 1 there is illustrated a color video projector composed of three cathode ray tubes 1R, 1G, and 1B which are respectively supplied with color signals of red, green and blue to produce red, green and blue picture images. These images are magnified and projected onto a screen 3 by means of lens systems 2R, 2G and 2B. The projected picture images are mixed or synthesized on the screen 3 as a color picture image. Reference character t denotes a video signal input terminal and reference numeral 4 a video signal separator circuit from which separated color signals are respectively supplied to electron guns of the corresponding cathode ray tubes, 1R, 1G and 1B. The apparatus includes a synchronizing separator circuit 5, a high voltage circuit 6 and a deflection circuit 7. The outputs from the high voltage circuit 6 and the deflection circuit 7 are supplied to anode buttons 8 and deflection yokes 9 of the cathode ray tubes 1R, 1G and 1B.

The cathode ray tubes 1R, 1G and 1B used in color video projectors must have a high brightness as compared with ordinary cathode ray tubes. Thus, each of the cathode ray tubes 1R, 1G and 1B is driven by a high voltage of 26 to 32 KV, with a current density of 20 to 50 times that used in ordinary cathode ray tubes. Accordingly, the cathode ray tubes 1R, 1G and 1B used in color video projectors create significant amounts of radiated X-rays and the deterioration of the phosphor layers due to the rise in temperature of the phosphor screen, the so-called temperature quenching, provides a distinct problem.

In order to avoid X-rays radiated from the cathode ray tube, it would be sufficient to employ a glass with a large X-ray absorption coefficient in the phosphor panel. However, such glass is likely to cause a browning phenomemon caused by the impingement of electron beams thereon, resulting in a decrease of brightness. Accordingly, when a glass whose X-ray absorption coefficient is relatively small is employed as a phosphor panel to avoid the browning phenomemon, the thickness must be increased as otherwise it is impossible to compleetely avoid the X-rays radiated from the cathode ray tube. However, if the thickness of the phosphor panel is increased, the heat radiation effect from the panel is lowered so that the deterioration of brightness caused by the rise of temperature on the phosphor screen is a more critical problem. Moreover, by virtue of the lens system 2R, 2G and 2B being placed in front of the panels of the cathode ray tubes 1R, 1G and 1B as shown in FIG. 1, it is preferable that the thickness of the panels be reduced as much as possible.

In cathode ray tube apparatus of the liquid cooling type since the phosphor panel and the front panel are formed of glass which does not easily cause the browning phenomenon, the total thickness of the phosphor panel and front panel is substantially the same as that of the prior art phosphor panel.

In general, if the intensity of X-rays generated from the cathode ray tube is taken as $I_0$, the X-ray absorption coefficient of the glass panel is identified as $\mu$, and the thickness of the glass panel as t, the intensity I of the X-rays passing through the glass panel is expressed by the following equation:

$$I = I_0 e^{-\mu t} \quad (1)$$

For a conventional 7-inch cathode ray tube apparatus of the liquid cooling type, there can be utilized a glass A having the following compositions:

| Composition | Glass A | |
|---|---|---|
| $SiO_2$ | 61.2 | weight % |
| $Al_2O_3$ | 2.0 | |
| SrO | 10.0 | |
| BaO | 8.2 | |
| $ZrO_2$ | 1.0 | |
| $Na_2O$ | 7.7 | |
| $K_2O$ | 7.7 | |
| $CeO_2$ | 0.3 | |
| $TiO_2$ | 0.5 | |
| $Sb_2O_2$ | 0.35 | |
| $Fe_2O_3$ | 0.05 | |
| ZnO | 1.0 | |
| MgO | | |
| CaO | | |
| PbO | | |
| $As_2O_3$ | | |
| $B_2O_3$ | | |
| X-ray absorption coefficient $\mu(cm^{-1})$, 27 KV, 0.45 Å | 13.5 | |

When glass A is employed to avoid the X-rays radiated from the cathode ray tube it is sufficient for purposes of mechanical strength that the total thickness of the phosphor panel and the front panel is about 11.5 mm. If this thickness is distributed equally between the phosphor panel and the front panel, the thickness of each becomes 5.75 mm.

In accordance with the present invention, there is provided a cathode ray tube apparatus capable of avoiding X-rays radiated from the cathode ray tube and increasing the heat radiation effect on the phosphor screen. This is accomplished by reducing the thickness of the panel without lowering the brightness of the phosphor substance. The cathode ray tube apparatus has a phosphor panel utilizing an X-ray shield glass formed of glass having a relatively small X-ray absorption coefficient to avoid the occurrence of the browning phenomenon and to keep the brightness of the picture from being lowered. In a preferred form of the invention, the cathode ray tube apparatus includes a lens of large optical transmissivity which is utilized in conjunction with panels of reduced thickness to provide a brighter picture image.

Figure 2:
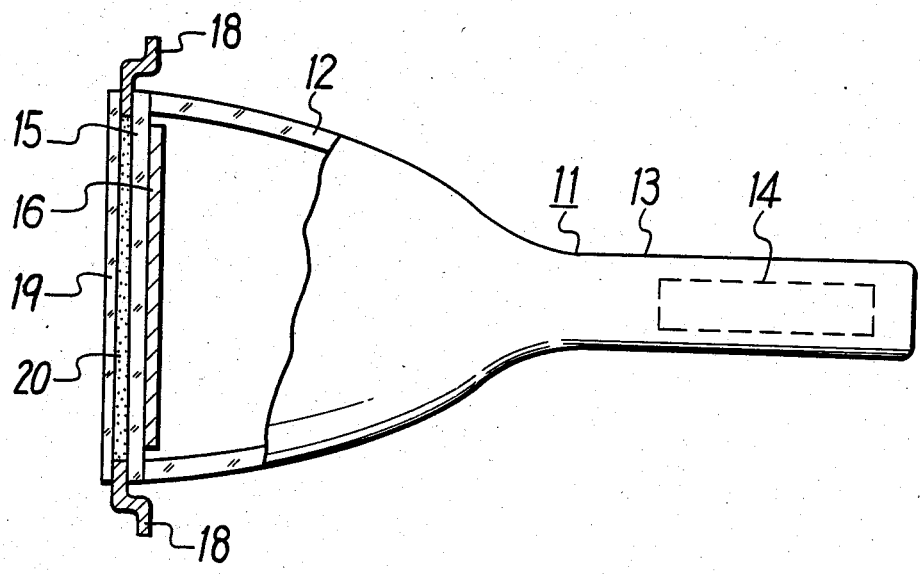
FIG. 2 is a view partly in elevation and partly in cross section of a cathode ray tube apparatus according to the present invention.
Figure 3:
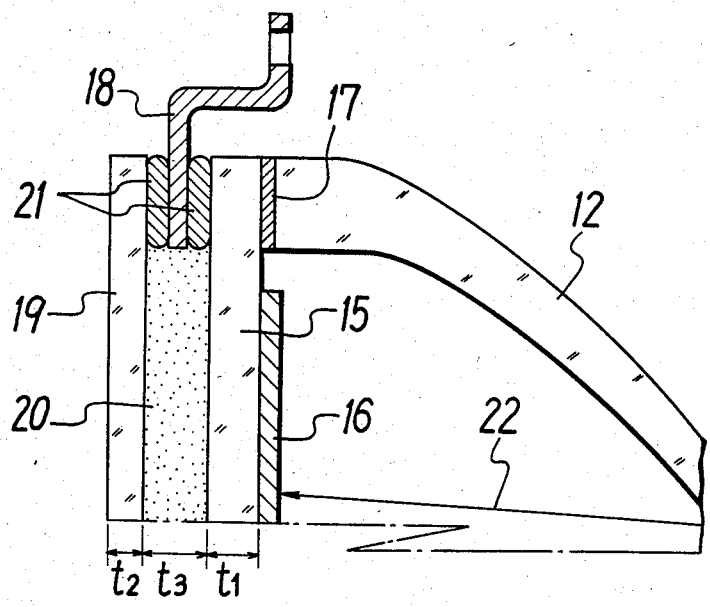
FIG. 3 is an enlarged fragmentary view of a portion of the tube shown in FIG. 2.

Referring to FIGS. 2 and 3, there is shown an embodiment of a cathode ray tube apparatus of the liquid cooling type according to the present invention. The cathode ray tube apparatus has a tube envelope 11, a conical funnel portion 12, and a neck portion 13 in which there is incorporated an electron gun 14. A first glass panel 15 consisting of a phosphor panel having a phosphor layer of surface 16 formed thereon is subjected to electron impingement from the gun 14. The phosphor panel 15 and the conical funnel portion 12 are sealed in air-tight relationship by means of a fritted glass layer 17.

In accordance with the present invention, a second glass panel 19 is incorporated in front of the phosphor panel 15 through a spacer 18. The spacing between the panels 15 and 19 is filled with a liquid coolant 20 such as ethylene glycol or the like. The spacer 18 is formed in the shape of a frame by means of a die-cast manufacturing process, for example, from aluminum and is sealed between both the panels 15 and 19 by a resinous bonding or adhesive layer 21 in liquid-tight relationship. The spacer 18 is used as a heat radiating plate which contacts the liquid coolant 20 to radiate the heat from the liquid coolant 20 and also is used as an attaching means for attaching a cathode ray tube to the cabinet. In a cathode ray tube of the liquid cooling type even though the temperature of the phosphor surface 16 rises by impingement of the electron beam from the high voltage source, the heat generated by the irradiation of the electron beam 22 is conducted through the phosphor panel 15 to the liquid coolant 20 and then radiated through the spacer 18 or the heat may be radiated through the front panel 19. As a result, the rise in temperature of the phosphor surface 16 is suppressed and the deterioration of brightness is largely avoided.

In the cathode ray tube of the present invention, the front panel 19 has an X-ray absorption coefficient which is larger than that of the phosphor panel 15. Such an X-ray absorbing glass may contain a large amount of metal oxide such as lead oxide and the like. Normally, a glass containing large quantities of metal oxides leads to the browning phonomenon by the impingement of the electron beams. However, in the present invention since the front panel 19 is not subjected to the direct impingement of the electron beam, it can be formed of a glass having a large X-ray absorption coefficient $\mu$. Since the glass has a large X-ray absorption coefficient, its thickness $t_2$ can be reduced, without danger of passing the X-rays therethrough.

The phosphor panel 15 is formed of a glass which has a relatively small X-ray absorption coefficient $\mu$ which is not subject to the browning phenomenon so that the decrease of optical transmissivity of the panel will not occur and the brightness of the picture image will be retained. The glass having the small X-ray absorption coefficient can be subjected to a reinforcing treatment such as a quenching treatment, a surface ion exchange treatment, or the like. If the phosphor panel 15 is formed of a glass such as a reinforcing glass having a large mechanical strength, the thickness $t_1$ of the phosphor panel 15 can be reduced. As a result, the heat generated on the phosphor surface 16 can be conducted efficiently to the liquid coolant and heat removal by radiation from the phosphor surface is efficiently performed, and a relatively uniform temperature is achieved.

In the cathode ray tube of the liquid cooling type, since the phosphor panel 15 has a sufficient mechanical strength, the front panel 19 is not required to maintain the mechanical strength. Consequently, by increasing the amount of metal oxides which are good X-ray absorbers, the thickness $t_2$ of the front panel 19 can be reduced so that the heat conducted through the liquid coolant 20 can effectively be radiated to the outside air.

If the thickness $t_1$ of the phosphor panel 15 and the thickness $t_2$ of the front panel 19 are both reduced, the total thickness, $t_1+t_2+t_3$ where $t_3$ is the thickness of the layer of liquid coolant can also be reduced, so that the lens system shown in FIG. 1 can be placed near the phosphor screen. Consequently, a lens of large optical transmissivity can be designed and the illuminated optical transmissivity from the phosphor surface 16 can be increased to produce a brighter picture image on the screen 3.

When it is not necessary to reduce the total thickness $t_1+t_2+t_3$ as described above, the thickness $t_3$ of the layer of liquid coolant 20 can be increased by an amount corresponding to a reduction of the thickness $t_1$ of the phosphor panel and the thickness $t_2$ of the front panel 19 resulting in an improved heat radiation effect.

The relationship between the thicknesses $t_1$ and $t_2$ of the panels 15 and 19 to the X-ray absorption coefficient $\mu$ will be described in succeeding practical examples.

The front panel 19 of the cathode ray tube of the invention can be formed, for example, from a glass B or C having the following compositions.

| Composition | Glass B | | Glass C | |
|---|---|---|---|---|
| $SiO_2$ | 51.4 | weight % | 33.4 | weight % |
| $Al_2O_3$ | 3.7 | | 0.2 | |
| BaO | 0.5 | | 5.0 | |
| $Na_2O$ | 6.0 | | 0.5 | |
| $K_2O$ | 8.5 | | 2.0 | |
| $Sb_2O_2$ | 0.2 | | 0.5 | |
| MgO | 2.0 | | | |
| CaO | 4.0 | | 0.3 | |
| PbO | 23.5 | | 55.0 | |
| $As_2O_3$ | 0.2 | | | |
| $B_2O_3$ | | | 3.1 | |
| X-ray absorption coefficient $\mu(cm^{-1})$, (27 KV, 0.45 Å) | 30 | | 90 | |

By way of example, the phosphor panel 15 can be made of a glass A having an X-ray absorption coefficient $\mu_1$ of 13.5 $cm^{-1}$, and the front panel 19 made of a glass B having an X-ray absorption coefficient $\mu_2$ of 30 $cm^{-1}$.

In a 7-inch cathode ray tube of the liquid cooling type, to achieve adequate mechanical strength it is sufficient that the thickness $t_1$ of the phosphor panel 15 is 5 mm or more, while the thickness $t_2$ of the front panel 19 is 2 mm or more.

If the thickness $t_1$ of the phosphor panel 15 is taken as 5.75 mm, equation (1) can be expressed as follows:

$$I = I_0 e^{-(13.5\times1.15)} \quad (2)$$

$$= I_0 e^{-(13.5\times0.575+30\times t2)}$$

Figure 4A:
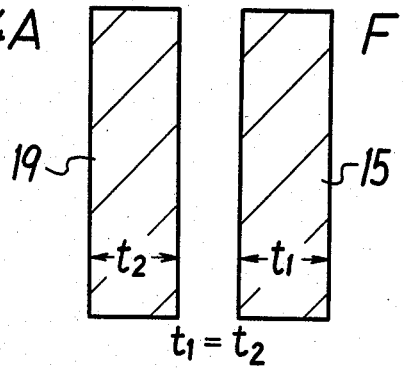
FIGS. 4A and 4B are cross-sectional views illustrating the thickness relationships between the phosphor panel and the front panel in accordance with the present invention.
Figure 4B:
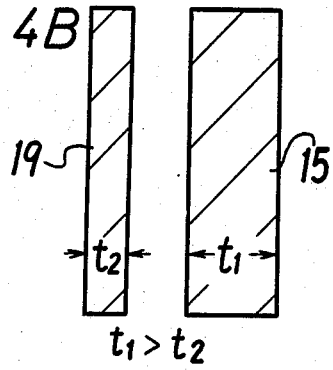

Thus, as shown in FIG. 4B, the thickness $t_2$ of the front panel 19 is approximately equal to 2.6 mm.

If the X-ray absorption condition of the cathode ray tube remains the same, from the equation (2) the thicknesses $t_1$ and $t_2$ can be calculated as:

$$\mu_1\times t_1+\mu_2\times t_2=1.15\times13.5=15.525 \quad (3)$$

where $t_1$ and $t_2$ are expressed in cm. Consequently, if the X-ray absorption coefficient $\mu_1$ is approximately 13.5 $cm^{-1}$, and the X-ray absorption coefficient $\mu_2$ of the front panel 19 is about 30 $cm^{-1}$, from equation (3) the thicknesses $t_1$ and $t_2$ can be selected in combination as indicated in the table below:

| thickness $t_1$ of the phosphor panel 15 | | thickness $t_2$ of the front panel 19 | | total thickness $t_1 + t_2$ | |
|---|---|---|---|---|---|
| 5.0 | mm | 2.9 | mm | 7.9 | mm |
| 6.0 | | 2.5 | | 8.5 | |
| 7.0 | | 2.0 | | 9.0 | |

-continued

| thickness $t_1$ of the phosphor panel 15 | thickness $t_2$ of the front panel 19 | total thickness $t_1 + t_2$ |
|---|---|---|
| 5.75 | 2.6 | 8.35 |

Thus, if the front panel 19 is made of a glass having an X-ray absorption coefficient $\mu_2$ larger than the X-ray absorption coefficient $\mu_1$ of the glass which forms the phosphor panel 15 instead of both types of glass having the same X-ray absorption coefficient, the total thickness of the phosphor panel 15 and the front panel 19 can be reduced by about 2.5 to 3.6 mm without changing or degrading the X-ray absorption capability.

Figure 5:
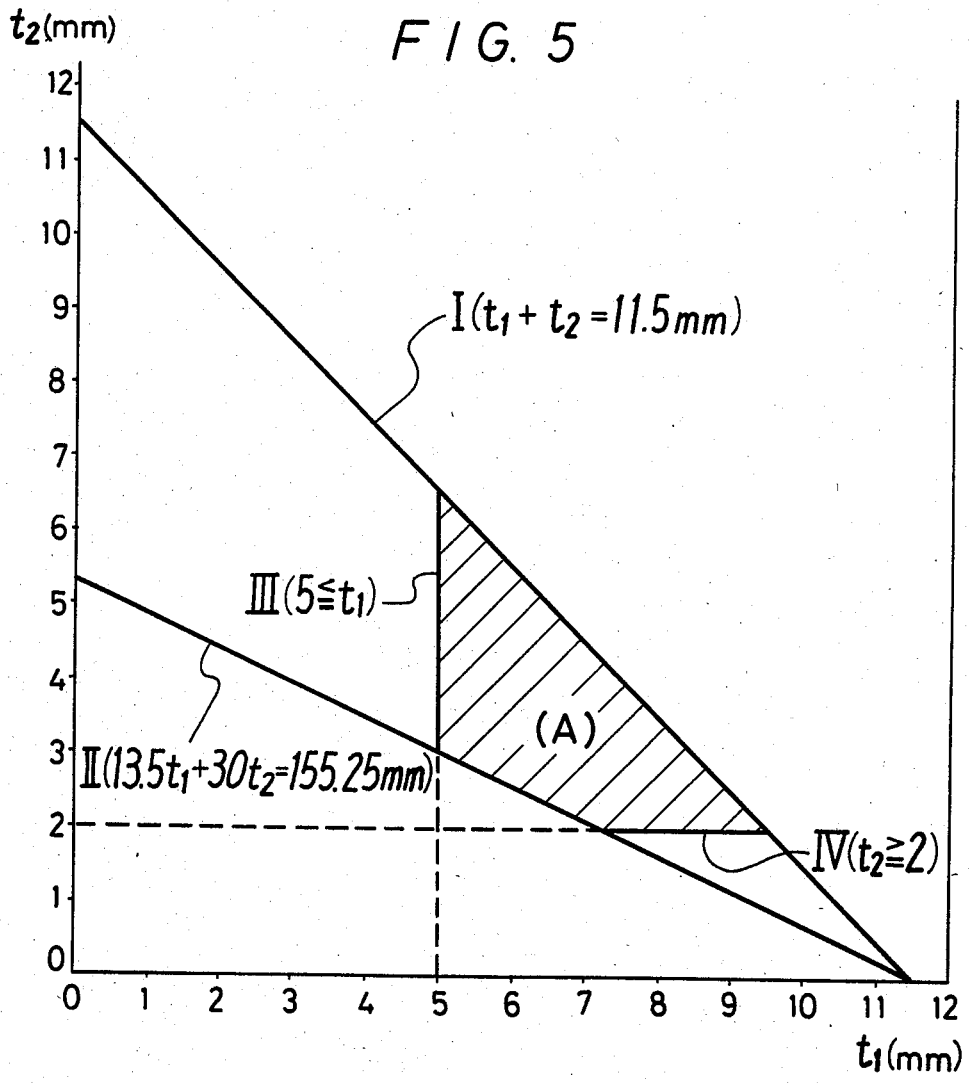
FIG. 5 is a graph indicating the range of usable thicknesses for the phosphor panel and the front panel.

As shown in the illustrative graph of FIG. 5, when the total thickness $t_1+t_2$ of the phosphor panel and the front panel 19 are about the same, as in the prior art (solid straight line I) and the total X-ray absorption of the respective panels is that of the prior art (solid straight line II), the respective thicknesses $t_1$ and $t_2$ of the phosphor panel 15 and the front panel 19 can be selected from the range shown by the cross-hatched area (A) shown in FIG. 5.

In the case of a 5-inch cathode ray tube of the liquid cooling type driven at a voltage of 32 KV, when the phosphor panel 15 is made of glass A in which the X-ray absorption coefficient $\mu_1$ is 13.5 $cm^{-1}$, and the front panel 19 is made of a glass C in which the X-ray absorption coefficient $\mu_2$ is 90 $cm^{-1}$, the thickness $t_1$ of the phosphor panel 15 and the thickness $t_2$ of the front panel 19 can be set at 4 mm and 3 mm, respectively.

As noted above, the cathode ray tube apparatus of the present invention significantly decreases the amount of X-rays being radiated from the cathode ray tube, while the thickness of the panels is reduced to enhance the heat radiation effect of the phosphor screen. The brightness of the phosphor materials is therefore not deteriorated by a rise of temperature on the phosphor surface.

Since the phosphor panel is made of a glass whose X-ray absorption coefficient is relatively small, the browning phenomenon of a phosphor panel is avoided and the brightness of the picture image thereon is not deteriorated.

Furthermore, in accordance with the present invention, the reduction of the thickness of the panel makes it possible to design a lens of large optical transmissivity so that a brighter picture image can be formed.

The above description is directed to a single preferred embodiment of the invention, but it will be apparent that many modifications and variations can be effected by one skilled in the art without departing from the spirit or scope of the novel concepts of the invention, so that the scope of the invention should be determined by the appended claims.

We claim as our invention:

1. A cathode ray tube apparatus comprising:

an envelope having a first panel with a phosphor coating on the inner surface thereof, a neck portion, an electron gun in said neck portion, a funnel portion connecting said first panel with said neck portion, a second panel in spaced relation to said first panel, a liquid coolant confined in the space between said first and second panels, and means providing a sealed enclosure between said first and second panels for confining said liquid coolant, the X-ray absorption coefficient of the second panel being significantly greater than that of said first panel, the thicknesses of said first and second panels being such that they are within the cross-hatched area "A" of FIG. 5 of the drawings.

2. A projection type cathode ray apparatus comprising:

a plurality of cathode ray tubes and optical lens systems operatively associated therewith, each cathode ray tube having a first panel with a phosphor layer formed on the inner surface thereof, a second panel facing the external surface of said first panel, a spacer securing said first and second panels together in spaced sealed relation, and a liquid coolant confined in the space between said first and second panels, said second panel having an X-ray absorption coefficient significantly larger than that of said first panel, the thicknesses of said first and second panels being selected so as to lie within the cross-hatched area "A" of FIG. 5

3. A cathode ray tube apparatus comprising:

an envelope having a first panel with a phosphor coating on the inner surface thereof, a neck portion, an electron gun in said neck portion, a funnel portion connecting said first panel with said neck portion, a second panel in spaced relation to said first panel, a liquid coolant confined in the space between said first and second panels, and means providing a sealed enclosure between said first and second panels for confining said liquid coolant, the X-ray absorption coefficient of the second panel being significantly greater than that of said first panel, the thickness of said first panel, $t_1$, and of said second panel, $t_2$, being related such that their values in millimeters simultaneously satisfy the following equations:

$t_1$ plus $t_2$ is less than or equal to 11.5

$13.5t_1$ plus $30t_2$ is greater than or equal to 155.25

$t_1$ is greater than or equal to 5 and $t_2$ is greater than or equal to 2.

* * * * *